United States Patent [19]

Schlott

[11] 3,951,120

[45] Apr. 20, 1976

[54] DIAPHRAGM-CONTROLLED PRESSURE CONTROL VALVE ASSEMBLY

[75] Inventor: Walter Schlott, Fellbach, Germany

[73] Assignee: Robert Bosch G.m.b.H., Stuttgart, Germany

[22] Filed: Aug. 6, 1974

[21] Appl. No.: 495,251

[30] Foreign Application Priority Data

Aug. 10, 1973 Germany ..... 2340480

[52] U.S. Cl. ..... 123/139 AW; 251/61.1

[51] Int. Cl.[2] ..... F02M 39/00

[58] Field of Search .... 123/139 AW, 119 R, 179 G; 261/50 A; 251/61.1

[56] References Cited

UNITED STATES PATENTS

| | | | |
|---|---|---|---|
| 3,521,850 | 7/1970 | German | 251/61.1 |
| 3,680,535 | 8/1972 | Eckert | 123/139 AW |
| 3,728,993 | 4/1973 | Eckert | 123/139 AW |
| 3,730,155 | 5/1973 | Knapp | 123/139 AW |
| 3,791,359 | 2/1974 | Eckert | 123/139 AW |
| 3,835,828 | 9/1974 | Knapp | 123/139 AW |
| 3,842,813 | 10/1974 | Eckert | 123/139 AW |
| 3,861,642 | 1/1975 | Maddocks | 251/61.1 |

*Primary Examiner*—Charles J. Myhre
*Assistant Examiner*—Daniel J. O'Connor
*Attorney, Agent, or Firm*—Edwin E. Greigg

[57] ABSTRACT

A diaphragm-controlled pressure control valve assembly is provided, especially for fuel injection systems in internal combustion engines, in which a measuring member, disposed within the suction tube, is moved by aspirated air against a resetting force. The resetting force is supplied by a pressurized fluid, delivered through a pressure line, which continually acts upon the measuring member. The pressure, which is normally constant, can be arbitrarily changed by pressure control valves. At least one of the pressure-control valves is embodied as a flat-seat valve in which the pre-load of its movable valve member can be changed in dependence on parameters. The movable valve member is constituted by a first diaphragm on whose side pointing away from a fixed valve seat there is disposed a second diaphragm in positive contact with the first diaphragm. The second diaphragm is preferably provided with a relief bore. In a preferred embodiment, two pressure-control valves of similar construction are provided, each including two diaphragms.

5 Claims, 2 Drawing Figures

DIAPHRAGM-CONTROLLED PRESSURE CONTROL VALVE ASSEMBLY

BACKGROUND OF THE INVENTION

This invention relates to a diaphragm-controlled pressure control valve assembly, especially for fuel injection systems in internal combustion engines, in which a measuring member, disposed within a suction tube, is moved by aspirated air against a resetting force. The resetting force is supplied by a pressurized fluid, delivered through a pressure line, which continually acts upon the measuring member at a pressure which is normally constant, but which can be arbitrarily changed by means of pressure control valves.

The purpose of fuel injection systems of this kind is to create automatically a favorable fuel-air mixture for all operational conditions of the internal combustion engine so as to make possible complete combustion of the fuel and thus to avoid, or at least to sharply reduce, the production of toxic exhaust constituents while maintaining the highest possible power of the internal combustion engine or the least possible fuel consumption. Thus, the fuel quantity must be metered out very precisely according to the requirements of each operational condition of the internal combustion engine and the proportionality between the air quantity and the fuel quantity must be changed in dependence on the motor parameters such as r.p.m., load and temperature.

The change of the proportionality existing between the air quantity and the fuel quantity metered out, in dependence on engine parameters, occurs through changing the resetting force acting on the measuring member; this is done by means of pressure control valves, wherein a thin, spring-loaded steel diaphragm cooperates with a fixed valve seat. In certain pressure regions, this diaphragm spring system oscillates at its natural frequency. The oscillation not only produces an unpleasant whistle, but it also causes symptoms of wear which, in turn, result in impermissible pressure changes.

SUMMARY OF THE INVENTION

It is an object of the present invention to provide a diaphragm-controlled pressure control valve assembly which avoids the production of an unpleasant whistle by its diaphragm/spring system.

It is another object of the present invention to provide a diaphragm-controlled pressure control valve assembly which reduces the symtoms of wear caused by oscillation of its diaphragm/spring system at the natural frequency of this system.

It is a further object of the present invention to provide a diaphragm-controlled pressure control valve assembly which reduces undesirable pressure changes, otherwise caused by symptoms of wear.

The foregoing objects, as well as others which are to become clear from the text below, are accomplished in a diaphragm-controlled pressure control valve, particularly for fuel injection systems of internal combustion engines, in which a measuring member, disposed within the suction tube, is moved by aspirated air against a resetting force. The resulting force is supplied by a pressurized fluid, delivered via a pressure line, which continually acts upon the measuring member. The pressure, which is normally constant, can be arbitrarily changed by virtue of at least one pressure control valve.

According to the present invention, at least one of the pressure control valves is embodied as a flat-seat valve in which the preloading of the movable valve member is changeable in dependence on operational parameters. The movable valve member is a first diaphragm on whose side facing away from a fixed valve seat, there is disposed a second diaphragm in positive contact.

The adjoining of the second diaphragm changes the operating characteristics of the valve only insignificantly and does not impair its sealing and seating properties. The occurrence of oscillations could also be prevented by using a thicker diaphragm, but this would impermissibly alter the operational characteristics of the valve and would additionally prevent the snug attachment of the thin diaphragm to the fixed valve seat, which is required for proper sealing.

In a particularly advantageous embodiment of the invention, the second diaphragm is provided with a relief (ventilation) bore. The two diaphragms can prevent the onset of oscillations only if they are in flat positive contact. Thus, it is a condition that neither dirt, air nor fluid must get into or be clamped between the two diaphragms. This is further required because otherwise pressure changes would be possible during operation. For this reason, a so-called relief bore is disposed in the second diaphragm through which air or fluid can escape during the assembly.

BRIEF DESCRIPTION OF THE DRAWING

Two exemplary embodiments of the invention are shown, in simplified form, in the drawing.

DESCRIPTION OF THE PREFERRED EMBODIMENTS

Figures 1, 2:
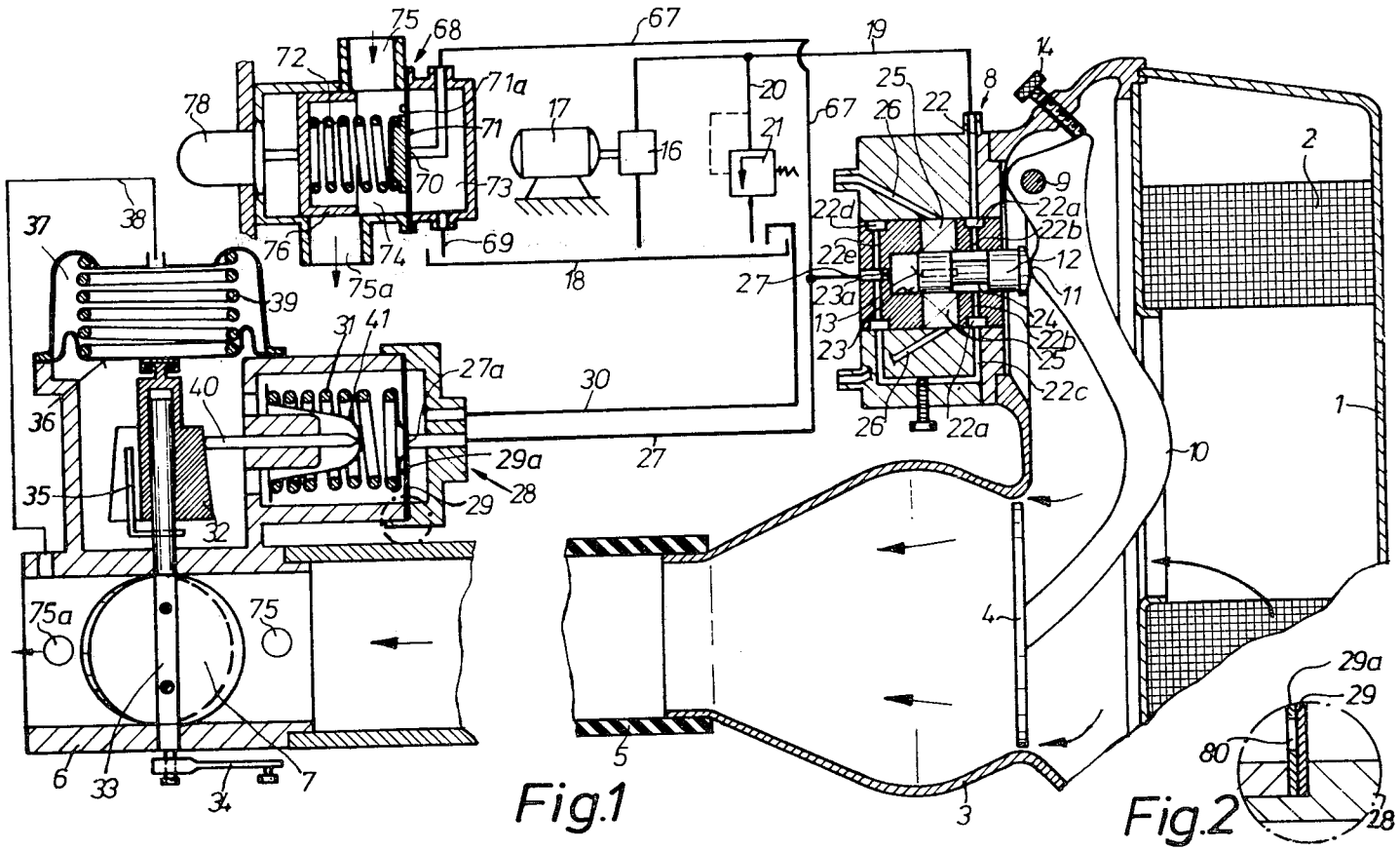
FIG. 1 shows a fuel injection system having two diaphragm-controlled pressure control valves, according to an exemplary embodiment of the present invention.
FIG. 2 shows an enlarged portion of a pressure control valve, which can be used in the present invention.

In the fuel injection system shown in FIG. 1, combustion air flows in the direction of the arrow through an air filter 2 disposed in a housing 1, further through a suction tube section 3 containing a movable measuring member 4. The air further flows through a connecting hose 5 and a further suction tube section 6 containing an arbitrarily actuatable throttle flap 7 and further to one or several cylinders (not shown) of an internal combustion engine. The measuring member 4 is a plate disposed transversely with respect to the direction of air flow. The member 4 moves within the suction tube section 3 according to an approximately linear function of the air quantity flowing through the suction tube, wherein if the resetting force acting upon the measuring member 4 is constant and the air pressure prevailing ahead of the measuring member 4 is also constant, then the pressure prevailing between the measuring member 4 and the throttle flap 7 is constant as well.

The measuring member 4 directly controls a quantity distribution valve embodied as a metering valve 8.

Connected to the measuring member 4, and serving for the transmission of its setting motions, is a lever 10, mounted with the least possible friction on a shaft 9. The lever 10 is equipped with a projection 11 which, during pivotal motions of the lever 10, actuates a valve member 12 embodied as a slide, forming part of the metering valve 8. A face 13 of the slide 12 pointing away from the projection 11 is acted upon by pressurized fluid which serves as the resetting force for the measuring member 4. The normal quiescent position of the lever 10 is determined by a set screw 14.

Fuel is supplied by a fuel pump 16 driven by an electric motor 17. The fuel pump 16 pumps fuel from a fuel container 18 through a line 19 to the metering valve 8. Branching off from the line 19 is a return line 20 containing a pressure limiting (sustaining) valve 21. Fuel flows from the line 19 to a channel 22 extending within the housing of the metering valve 8. This channel 22 terminates in an annular groove 22*a*, disposed in the housing of the metering valve 8, from which at least one bore 22*b* leads to a cylindrical bore 23 within which glides the slide 12 in the axial direction and with tight fit. The bore 22*b* terminates in a cylinder 23 at a location at which the slide 12 is provided with an annular groove 24 which, therefore, communicates without throttling with the annular groove 22*a* and which, depending on the position of the control slide 12, overlaps control slits 25 to a greater or lesser degree. Fuel flows from the control slits 25 into channels 26 which lead to the individual injection valves (not shown) located in the suction tube of the internal combustion engine. From the annular groove 22*a*, the part of the fuel which does not reach the channels 26 flows into a channel 22*c* and further into an annular groove 22*d* and hence through bores 22*e* into a line 27 leading to a pressure control valve 28 which communicates with the cylindrical bore 23 of the slide 12 at the face 13. This passageway contains a throttle 23*a* by virtue of which the movements of the slide 12 are damped. The channel 22*c* also contains a throttle in order to reduce as much as possible the influence of pressure changes in the metering system on the resetting system. The pressure control valve 28 is embodied as a diaphragm valve and, more particularly, as a flat-seal valve having a fixed valve seat 27*a* and a first diaphragm 29, serving as a movable valve member, on whose side pointing away from the fixed valve seat 27*a* there is disposed a second diaphragm 29*a* in positive contact. The slightest movement of the first diaphragm 29 suffices to open the full annular cross-section of the valve. The overflowing fuel is returned without pressure to the fuel container 18 via a line 30. The first diaphragm 29 is loaded by a spring 31 whose pre-load is changeable by corrective variables depending on engine parameters. This purpose is served by a three-dimensional (spacial) cam 32, rotatable in unison with the throttle flap 7 and axially slidable in dependence on the reduced pressure prevailing in the suction tube downstream from the throttle flap 7.

For this purpose, the three-dimensional cam 32 is mounted axially slidable on a shaft 33 of throttle flap 7 which can be arbitrarily rotated via a lever 34. The rotational motion of the shaft 33 is transferred to the three-dimensional cam 32 by a motion transfer lever 35. One end face of the three-dimensional cam 32 is rotatably fastened to a diaphragm 36 of a reduced pressure chamber 37. The reduced pressure chamber 37 communicates, via a line 38, with a location of the suction tube downstream of the throttle flap 7. When the pressure reduction is sufficient, the three-dimensional cam 32 is axially displaced by the diaphragm 36 in opposition to the force of a resetting spring 39. This three-dimensional cam 32 is followed by a follower pin 40 whose motions are transmitted, via a spring support cup 41, to the spring 31 whose pre-load determines the pressure for the resetting force of the measuring member 4.

Branching off from the line 27 is a line 67, leading to a second pressure control valve 68 with a further pressure-free communication through a return line 69 back to the fuel container 18. By means of the pressure control valve 68, the pressure for the resetting force of slide 12 or the measuring member 4 is controllable in dependence on the engine temperature. The pressure control valve 68 is a flat-seat valve whose throughput is controlled by a first diaphragm 71, cooperating wit a fixed valve seat 70, and loaded in the direction of closing of this valve seat by a spring 72. On the face of the first diaphragm 71, which points away from the fixed valve seat 70, there is disposed a second diaphragm 71*a* in positive contact. Fuel flows through the line 67 past the valve seat 70 into a substantially enclosed space 73 and from there without pressure, via the return line 69, to the fuel container 18.

The fuel container 18 is under atmospheric pressure so that approximately atmospheric pressure also prevails in the space 73. A space 74, separated from the space 73 by the diaphragm 71, and containing the spring 72, is part of a bypass line 75, 75*a*, which bypasses the throttle flap 7 of the suction tube; only its terminations into the suction tube and into the pressure control valve 68 are shown in FIG. 1 for the sake of clarity. Disposed in the space 74, is a piston slide 76 controlling the effective cross-section of the bypass air line 75, 75*a* and also serving as a spring support for the spring 72.

The setting of the piston slide 76 occurs by virtue of a temperature-dependently operating member (expanding material regulator) 78 wherein, if the engine is cold, the spring 72 is compressed less and the bypass line 75, 75*a* is open wider than is the case of a warm engine. As a consequence, when the engine is cold, more fluid flows through the valve 68 and, hence, the pressure of the fluid acting as the resetting force is lower and the fuel quantity injected is greater in proportion to the air quantity.

FIG. 2 shows a section of the pressure control valve 28 in enlarged representation, illustrating the first diaphragm 29 and the second diaphragm 29*a* with a relief (ventilation) bore 80.

The operation of the fuel injection system described above, in operationally warmed-up condition of the engine, is as follows:

When the engine is running, the electric motor 17 drives the pump 16 which pumps fuel from the fuel container 18, via the line 19 to the metering valve 8. At the same time, the internal combustion engine aspirates air through the suction tube 3, 5, 6 resulting in a certain deflection of the metering member 4 from its normal, quiescent condition.

Depending upon the amount of this deflection of the measuring member 4, the lever 10 displaces the slide 12 which opens up a larger cross-section of the control slits 25. Thus, the fuel quantity reaching the motor fuel injection valves corresponds to the magnitude of the control parameter as determined by the measuring member 4. The remaining fuel flows from the annular groove 24 to the face of the slide 12 and from there to the two parallel pressure control valves 28 and 68.

The direct coupling of the measuring member 4 to the control slide 12 results in a constant proportion between air quantity and the metered-out fuel quantity as long as the characteristics of these two members are sufficiently linear, which is a desired condition. The air-fuel ratio would, in that case, be constant throughout the entire operational domain of the engine.

However, as has been explained above, it is required to make the fuel-air mixture richer or leaner depending on the operational domain of the engine, and this occurs, according to the invention, by changing the resetting force of the measuring member 4.

The measurement variables to indicate load and r.p.m. are the position of the throttle flap 7 and the reduced pressure in the suction tube 3,5,6 so that it is suitable to change the resetting force in dependence on these quantities. This is done in that, depending on the position of the throttle flap 7, or the magnitude of the pressure in the suction tube 3,5,6 appropriate rotation and/or axial sliding of the three-dimensional cam 32 results in changing the force of the spring 31 of the pressure control valve 28. For example, if during full-load operation, the throttle flap 7 is in a position in which the suction tube 3,5,6 is fully opened, then the maximum power, i.e., a relatively rich mixture is desired. Because the pre-loading of the spring 31 of the pressure control valve 28 determines the fuel pressure acting at the face 13 of the slide 12, the resetting force acting on the measuring member 4 must be slightly reduced so that the slide 12 will be pushed into a position in which the control slits 25 are further opened and a correspondingly larger fuel quantity is injected. Conversely, during partialload operation, a relatively higher pressure prevailing at the face 13 of the slide 12 results in a relatively smaller deflection of the measuring member 4, which leans out the mixture.

During overrunning operation, on the other hand, because of the sharply reduced pressure in the suction tube, the three-dimensional cam 32 is displaced very far in opposition to the force of the spring 30 so that the spring 31 of the pressure control valve 28 is greatly tensed. This correspondingly increases the resetting force of the measuring member 4 so that, in spite of small amounts of "leakage air" which flow past the normally closed throttle flap 7, no deflection of the measuring member 4, and hence no fuel injection can occur.

As long as the engine is cold, the pressure control valve 68 produces an increase of fuel in the fuel-air mixture because the pressure serving as resetting force is reduced. The fact that a part of the air flows through the bypass channel 75, 75*a* results in a greater deflection of measuring member 4 than would correspond to the actual position of the throttle flap 7 so that, for this reason alone, more fuel is metered out.

The pressure of the fuel acting on the face 13 of the slide 12, which acts as the resetting force for measuring member 4, is thus normally held constant and is changed only in dependence on engine parameters which, in the exemplary embodiment described, occurs on the basis of the throttle flap position, i.e., load dependently, as well as on the basis of reduced pressure in the suction tube 3,5,6 and hence also r.p.m. dependently.

The aim of the present invention relates not only to the exemplary embodiments described above but to any kind of pressure control valve wherein, within certain pressure domains, the diaphragm-spring system may oscillate and hence produce unpleasant whistles and symptoms of wear.

While the foregoing description relates to preferred exemplary embodiments, it is to be appreciated that numerous variants and other embodiments are possible within the spirit and scope of the present invention, the scope being defined in the appended claims.

What is claimed is:

1. In a pressure control valve assembly, in a fuel injection system of an internal combustion engine, the engine including a suction tube through which air is aspirated into the engine, the fuel injection system including: an air measuring member, disposed within the suction tube, said air measuring member being moved by the aspirated air against a resetting force; a pressure line operatively connected to the air measuring member, the resetting force being supplied by a pressurized fluid, delivered through the pressure line, which continually acts upon the air measuring member at a pressure which is normally constant but which can be arbitrarily changed by at least one pressure control valve, the improvement residing in the pressure control valve assembly wherein the pressure control valve assembly includes said at least one pressure control valve which is embodied as a flat-seat valve having a fixed valve seat, a movable valve member and means for applying a pre-load to said movable member such that the pre-loading may be changed in dependence on at least one engine parameter, and wherein said movable valve member includes a first diaphragm on whose side pointing away from the fixed valve seat there is disposed a second diaphragm in positive areal contact with said first diaphragm.

2. The pressure control valve assembly as claimed in claim 1, wherein said second diaphragm is provided with a relief bore.

3. The pressure controlled valve assembly as claimed in claim 1, wherein said at least one pressure control valve forms a first pressure control valve, and wherein the pressure control valve assembly further includes a second pressure control valve embodied as a flat-seat valve having a fixed valve seat, a movable valve member and means for applying a pre-load to its said movable valve member such that the pre-loading may be changed in dependence on at least one engine parameter, and wherein the movable valve member of said second pressure control valve includes a first diaphragm on whose side pointing away from the fixed valve seat there is disposed a second diaphragm in positive areal contact with its said fist diaphragm.

4. The pressure control valve assembly as claimed in claim 3, wherein said second diaphragm of said second pressure control valve is provided with a relief bore.

5. The pressure control valve assembly as claimed in claim 4, wherein said second diaphragm of said first pressure control valve is provided with a relief bore.

* * * * *